United States Patent [19]

Greenberg

[11] 4,043,737

[45] Aug. 23, 1977

[54] APPARATUS FOR CASTING IN MOLDS FOR THE PRODUCTION OF CERAMIC HOLLOWWARE

[75] Inventor: Jerome S. Greenberg, Chicago, Ill.

[73] Assignee: Regal China Corporation, Antioch, Ill.

[21] Appl. No.: 559,038

[22] Filed: Mar. 17, 1975

[51] Int. Cl.[2] ..... B28B 1/28

[52] U.S. Cl. ..... 425/434; 425/84; 425/435; 425/436 R; 425/450.1; 425/451; 425/453

[58] Field of Search ..... 425/434, 435, 436, 334, 425/84, 425, 450.1, 451, 453; 249/20; 264/315, 316

[56] References Cited

U.S. PATENT DOCUMENTS 832,690 10/1906 Morse ..... 249/137

2,361,906 11/1907 Anderson ..... 164/292

3,691,266 8/1972 Greenberg ..... 425/84

*Primary Examiner*—Robert L. Spicer, Jr.

*Attorney, Agent, or Firm*—Pennie & Edmonds

[57] ABSTRACT

A rotatable carriage for supporting split-type plaster molds for molding ceramic hollowware is disclosed, in which the molds are retained between two frames rotatable to a succession of positions in which the molds are retained in place between the framework of one of said frames and a dual cell inflatable member on the inner face of the other of said frames. The first of said frames includes a retaining member engaging the outer surface of said mold to prevent said mold from slipping relative to said frames. A new casting method is disclosed in which the slip is poured from the filled molds in at least two steps with the rotatable frames being rotated to a different position for each of said pouring steps.

7 Claims, 15 Drawing Figures

38
40
42
44
45
48
50
50a
50b
50c
52
60
72
92
94
96

APPARATUS FOR CASTING IN MOLDS FOR THE PRODUCTION OF CERAMIC HOLLOWWARE

THE PRIOR ART

It is known in the art of molding in plaster molds for the production of ceramic hollowware to support a plurality of such molds between a pair of frames mounted for rotation to successive positions during casting and in which the molds are retained between the frame members of one of said frames and an inflatable cell on the inner surface of the other of said frames by friction. U.S. Pat. No. 3,691,266, issued Sept. 12, 1972, discloses such an apparatus and method for molding ceramic hollowware.

While said prior art apparatus as disclosed in U.S. Pat. No. 3,691,266 and the method disclosed therein work very well for many applications, it has been found that for large molds used when casting large pieces of ceramic hollowware, the friction between the molds and the frame on one side and between the molds and the inflatable cell on the other side is insufficient to prevent the molds from slipping with respect to the frames during those steps of the process in which the weight of the molds and the slip therein is not directed downwardly against one of the frames but is exerted parallel thereto.

Additionally, for very small molds the cell must be inflated to such a degree that its point of contact with the mold becomes minimal and, further, as this limit is approached, the vulcanized seams of the cell are severely stressed.

Still further, it has been found that dumping of the excess slip in one sudden step results in a "sucking-in" or implosion of the casting wall in certain sizes of castings and for certain wall thicknesses.

BRIEF SUMMARY OF INVENTION

It has been found that by the use of a retaining member on one of the rotatable frames of a casting frame and the provision of cooperating grooves or notches on the cooperating molding halves, that much larger molds may be utilized without danger of the mold slipping with respect to the cooperating holding frames. It has also been found that by use of dual inflatable cells much smaller molds may be accommodated and castings may even be made with larger and smaller molds in the same frame thus permitting intermixing of mold sizes. The method of this invention also contemplates the pouring of the excess slip from the molds in at least two steps or stages thus preventing the sucking-in or implosion of the casting wall.

DESCRIPTION OF THE PREFERRED EMBODIMENT

Figure 1:
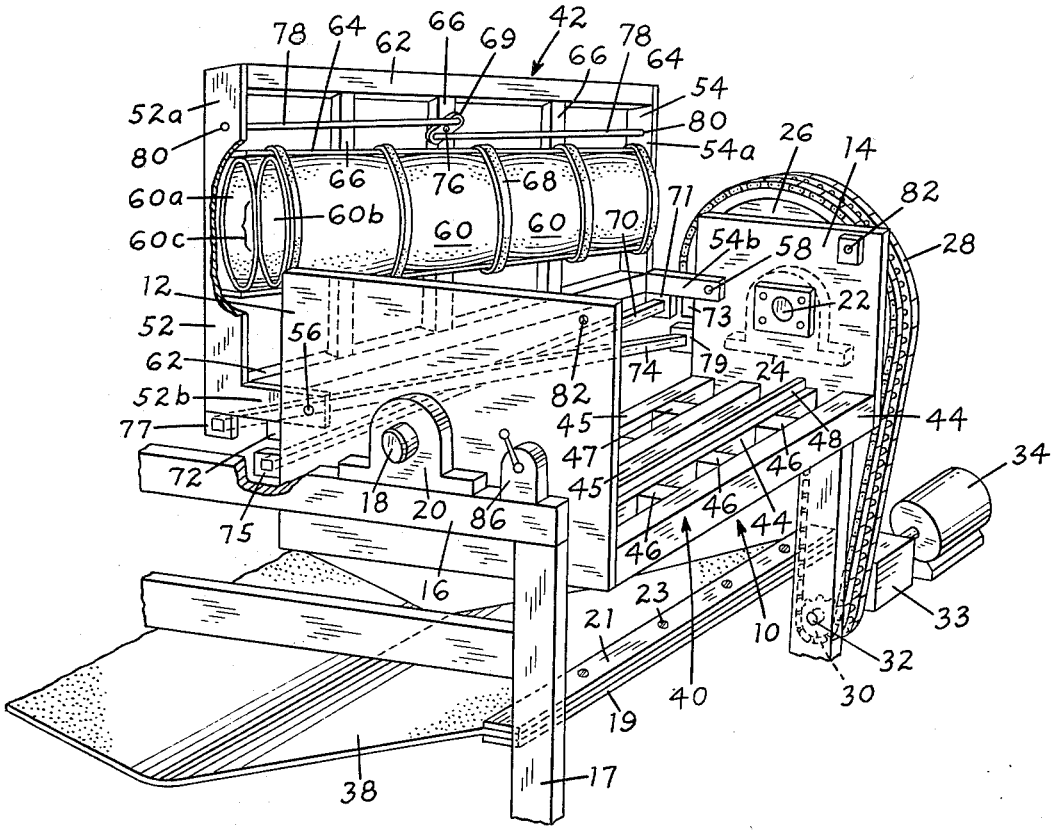
FIG. 1 is a perspective view, partially broken away, of a mold carriage assembly embodying the invention.
Figure 2:
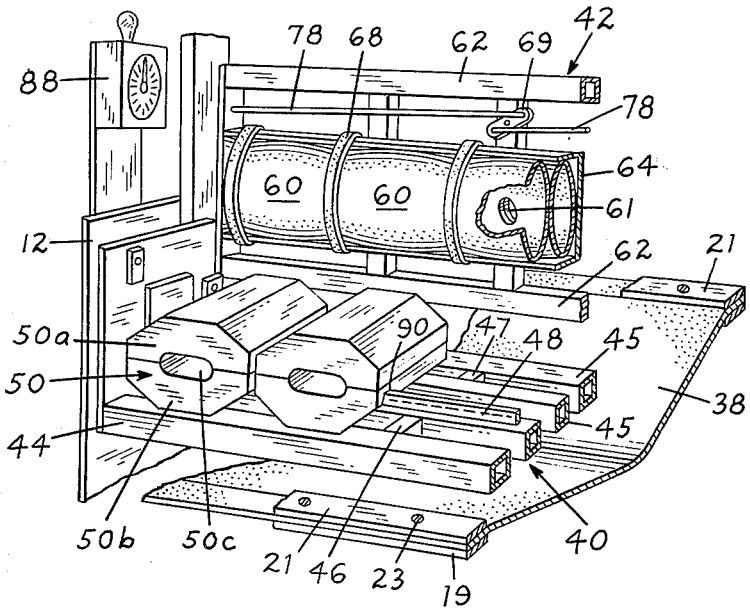
FIG. 2 is another perspective view of the mold carriage assembly but with the molds shown in place on one of the rotatable frame members.

The device of the present invention comprises a rotatable carriage generally indicated by the numeral 10 having end frame members 12 and 14 journaled in a fixed frame 16 by means of stub shaft 18 fixed to the end frame 12 and passing rotatably through a journal 20 mounted upon the fixed frame 16. A similar stub shaft 22 is fixed to the other end frame member 14 and passes through a cooperating journal 24 similar to the journal 20. The stub shaft 22 extends well beyond the journal 24 and has fixed thereon a sprocket wheel 26 having a chain 28 trained thereabout. The chain 28 extends downwardly and is also trained about a driving sprocket 30 fixed to the shaft 32 of a gear reducer 33 driven by an electric motor 34. An idler sprocket 36 shown only in the cutaway portion of FIG. 4 offsets the chain drive 28 towards the front of the apparatus as shown in order to permit the positioning of a collecting trough 38 beneath the carriage 10 for reasons that will hereinafter be apparent.

Mounted to the end frame members 12 and 14 is a first frame 40 and a second frame 42. The frame 40 comprises a first pair of metal, rectangular, tubular members 44 welded at one end to the end frame member 14 and at the opposite end to the end frame member 12. Between the members 44 are metal frame members 46 positioned transversely between members 44 and welded at their ends to said members 44. Toward the rear of frame 40 a second pair of frame members 45 are welded at their ends to end frame members 12 and 14. Extending transversely between frame members 45 are cross members 47. The upper surfaces of the longitudinal frame members 44 and 45 (the upper surface as viewed in FIG. 1) serve to support molds 50 as hereinafter more fully described. Running along the upper surface of one of the frame members 44 is a retaining member 48. The retaining member projects upwardly along the length of the member 44 and may be a bar, angle iron, channel member or any other cross section desired. As shown, the retaining member 48 is an upstanding flange welded to the upper surface of the frame member 45.

The other frame member 42 comprises opposite L-shaped end members 52 and 54 including a long upright arm **52*a* and 54*a*, respectively, and a shorter horizontal arm 52*b* and 54*b*, respectively, (upright and horizontal having reference to the showing in FIG. 1). The outer end of the arm 52*b* is pivoted at 56 to the end frame member 12 and the outer end of the arm 54*b* is pivoted at 58 to the end frame member 14. Longitudinal frame members 62 similar or identical in construction to the frame members 44 are welded at their opposite ends to the L-shaped end members 52 and 54. Between the members 62 and parallel therewith is a central frame member 64 which may be U-shaped in cross section, i.e. channel-shaped. The central channel member 64 is welded at its opposite ends to L-shaped end members 52 and 54. Positioned within the longitudinal channel member 64 is a dual cell inflatable member 60 having separate cells 60*a* and 60*b* each of which extends the full length, or substantially the full length, of the frame member 64. The inflatable member 60 may be of any suitable length of the frame member 64. The inflatable member 60 may be of any suitable material, but preferably each cell 60*a* and 60*b* comprises two overlying sheets of fabric-reinforced-synthetic rubber vulcanized together along their longitudinal and end edges. The adjacent walls of the cells 60***a* and 60*b* in the area indicated at 60*c* are vulcanized together as well. The entire assembly 60 of the two-celled-inflatable device is held in place by means of ties 68 which extend entirely around the inflatable device 60 and also around the longitudinal frame member 64. The ties 68 are preferably expandable strips of rubber located at chosen intervals along the length of the inflatable device 60. Metal cross braces 66 extend between the longitudinal members 62 and the channel member 64 in the frame 42 in order to lend rigidity and strength to the frame. The members 66 may be of any shape desired, but as shown, comprise rectangular tubular metal members welded to the longitudinal members 44, 45, 62 and 64 at their points of juncture.

As above mentioned, the frame 42 is pivoted at 56 and 58 and the access of movement runs through both pivots 56, 58. A stop member 72 secured as by welding to the end member 12 is engaged by the arm 52*b* of th L-shaped frame member 52 when the frame 42 is in its open position as shown in FIG. 1. A similar stop 73 is secured to the end member 14 and the horizontal leg 54*b* of the L-shaped end member 54 bears against the stop 73 when the frame 42 is in the open position in the same manner as just mentioned with respect to the leg 52*b* and the stop 72.

Torsion bars 70 and 74 are provided for aiding in counter-balancing the weight of the frame 42 in order to assist the operator in opening and closing the frame. The torsion bar 70 has one end secured in a plate 71 fixed to the bottom (as viewed in FIG. 1) of the L-shaped member 52. The other end of the bar 70 is secured in a plate 75 fixed to the end member 12 of the carriage 10. The torsion bar 74 is mounted in plates 77 and 79 fixed respectively to the members 52 and 14. It will be appreciated that torsion bars 70 and 74 are non-rotatably mounted in their respective plates 71, 75 and 77, 79. It will also be appreciated that as the frame 42 is pivoted about its pivots 56, 58, there will be a twisting or untwisting force applied to the torsion bars 70 and 74 depending upon the direction of movement about the pivot access 56, 58 and the pre-set twist that may be applied to the torsion bars 70, 74 when the device is assembled. Preferably, the torsion of the bars 70, 74 is adjusted in such manner that it is neutral in the 45° position - i.e. halfway between the fully open position shown in FIG. 1 and the fully closed position shown in FIG. 3. In this way, the torsion bars 70, 74 may assist both during the opening and the closing of the frame 42.

A suitable latch mechanism may be provided to latch the pivoted frame 42 in its closed position. As shown, it comprises a bell crank 69 mounted on a shaft 76 passing through one of the cross-frame members 66. The bell crank 69 at its opposite ends carries rods 78 extending through openings 80 in the end frames 52, 54 and (when the frame is closed) into openings 82 in the end walls 12 and 14. It will be appreciated that a handle, not shown, is fixed to the opposite end of shaft 76 and that by rotation of the bell crank 69 the rods 78 may be moved into and out of engagement with openings 82.

Figure 3:
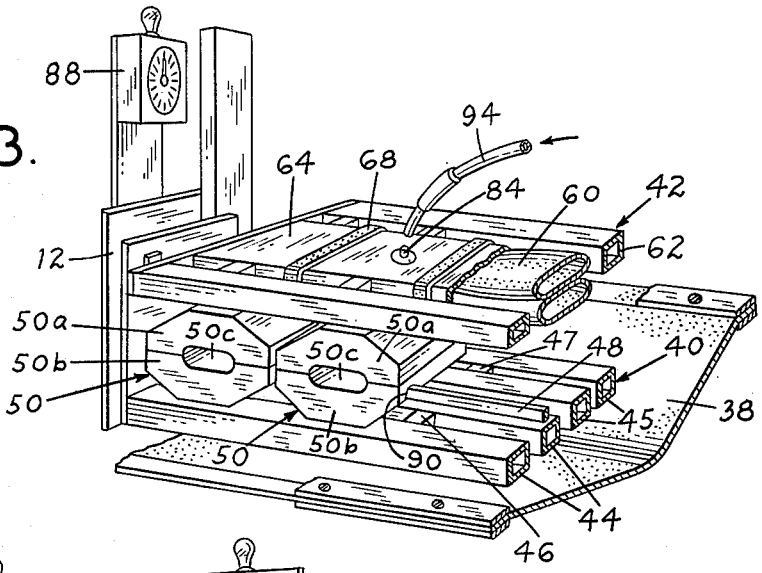
FIG. 3 is a partial perspective view in which the upper frame member has been lowered to its operative position in opposition to the first frame member.

As shown in FIG. 3, there is a valve stem 84 mounted to extend through and to be exposed on the outer surface of the channel member 64 when the frame member 42 is in its closed position as shown in FIG. 3. The valve stem 84 communicates with the inflatable cells 60*a* and 60*b* with both cells being inflated simultaneously. The two cells 60*a* and 60*b* inflate simultaneously due to an opening 61 through the adjacent vulcanized walls of the two cells 60*a* and 60*b.* This opening 61 is in the area 60*c* previously mentioned where the two separate cells are vulcanized together.

Figure 4:
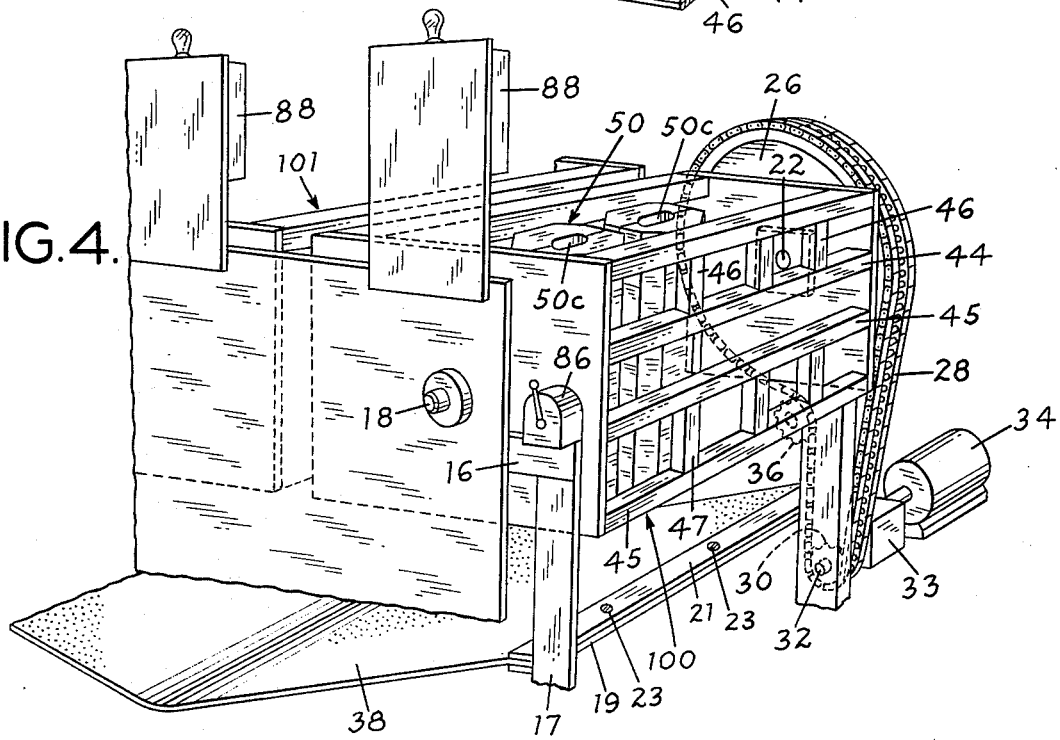
FIG. 4 is a partial perspective view of the carriage in the mold-filling position.

The trough 38 is preferably a fabric reinforced rubber material which extends beneath the device. As shown in FIG. 4, it is preferred to use two separately operated machines back to back. As generally indicated in FIG. 4, the first machine is indicated at 100 and the second machine arranged back to back with the first is indicated at 101. The trough 38 extends beneath both machines whereby it may serve two molding devices and is supported by the front legs 17 on the two devices. As shown in FIGS. 1 and 4, the trough 38 is supported by the legs 17 of the frame 16 on the device generally indicated at 100. The opposite edge of the trough 38 is similarly supported from the front legs (not shown) of the device 101.

The trough 38 may be supported in any one of a number of ways from the legs 17; however, as shown in FIG. 4, the support comprises a lower metal bar 19 welded to the legs 17. Another metal bar 21 overlies the edge of the trough 38 and is screwed by means of screws or bolts 23 to the fixed bar 19 thus clamping the trough 38 tightly between the fixed bar 19 and the removable bar 21. It will be noted that the idler sprocket 36 shown in FIG. 4 in dotted lines offsets the chain 21 so that the chain passes by the edge of the trough 38.

Figure 5:
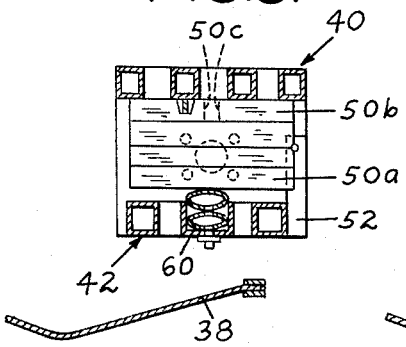
FIGS. 5, 6 and 6A are cross-sectional views in which the molds are positioned with their filler openings in various positions with respect to said carriage.
Figure 6:
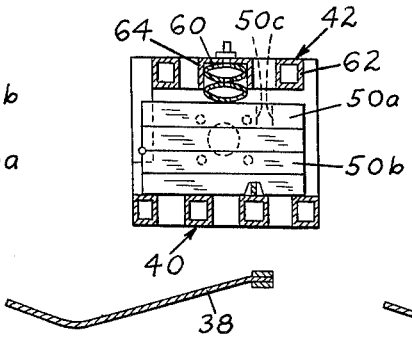
Figure 6A:
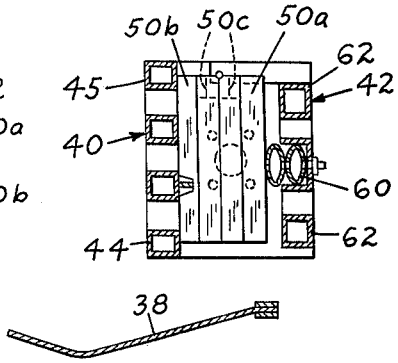

While the normal position of the molds is such that the filler opening 50*c* faces outwardly between the frames 40 and 42 as shown in FIGS. 3, 4 and 7 – 14, the design of the frames 40 and 42 permits of alternate arrangements as shown in FIGS. 5, 6 and 6*a.*

As shown in FIG. 5, the mold 50 has its filler opening 50*c* positioned between the frame members of the frame 40. Specifically, the opening 50*c* is positioned between the inner frame member 44 of the pair of frame members 44 and the inner frame member 45 of the pair of frame members 45. It will be appreciated that the opening 50*c* could as well have been shown positioned between the pair of members 44 or between the pair of members 45. While many mold shapes lend themselves to positioning of the filler opening 50*c* facing outwardly between the frames 40 and 42 as shown in FIGS. 1 – 4, certain shapes and sizes of molds are more conveniently handled if it is possible to fill the same by turning the side of the mold uppermost and filling through the frame and the side of the mold as shown in FIG. 5. It will be appreciated that the design of the frame 40, contrary to prior devices, easily lends itself to the use of such side filling molds since it provides spaces between the pair of members 44, the pair of members 45, and between the inner members of the pairs 44 and 45. It will be appreciated that when filling a mold through the frame 40 and through the side of the mold as shown in FIG. 5, it is necessary to rotate the carriage 10 180° from the position shown in FIG. 3 as compared with a rotation of 90° when the opening 50*c* is positioned between the frames 40 and 42 as shown in FIGS. 1 – 4. That is to say, that only a 90° rotation is required to bring the molds from the position shown in FIG. 3 to the filling position shown in FIG. 4 whereas if side filling is used then, in that event, a 180° rotation to the position shown in FIG. 5 is required.

FIGS. 6 and 6*a* show other positions for the filler opening 50*c* which may be utilized with the frames 40, 42 of the carriage 10 of this invention. As shown in FIG. 6, the opening 50*c* is also on the side of the mold, but it is the opposite side to that shown in FIG. 5. As shown in FIG. 6, the filler opening 50*c* is positioned between the frame members 64 and one of the frame members 62 of the upper pivoted frame 42. This position has the advantage that immediately upon closure of the upper frame 42 the molds 50 may be filled without rotating the carriage 10.

FIG. 6*a* shows the opposite situation from that shown in FIGS. 1 – 4 in that the mold opening 50c is positioned to the rear of the device (to the left as viewed in FIG. 1). In certain sizes and shapes of molds, this arrangement is advantageous despite the fact that there may be some slight difficulty in filling the molds in view of the location of the torsion bars 70 and 74. For these molds, however, the torsion bars 70 and 74 present very little problem since they are not of large cross-sectional size. It will be appreciated that in order to arrange the opening 50*c* of the molds uppermost as shown in FIG. 6*a*, the carriage 10 must be rotated 90°, but in the opposite direction from that used when moving from FIG. 3 to FIG. 4. Accordingly, the carriage 10 permits the filling of the molds 50 from any one of the four sides and it requires only that the carriage 10 be rotated to position the openings 50*c* upwardly. It will be obvious to anyone skilled in the art that the following operational sequence, which is directed to the use of molds with their openings directed as shown in FIGS. 3 and 4, will be slightly changed by the use of molds having their openings 50*c* in one of the other positions illustrated by FIGS. 5, 6 and 6*a*.

A manual switch 86 is provided for operating the motor 34 in either direction and for stopping the motor with the carriage 10 in any desired position. A timer 88 for operating the motor automatically is also provided.

OPERATION

Figures 7, 8, 9, 10, 11, 12, 13, 14:
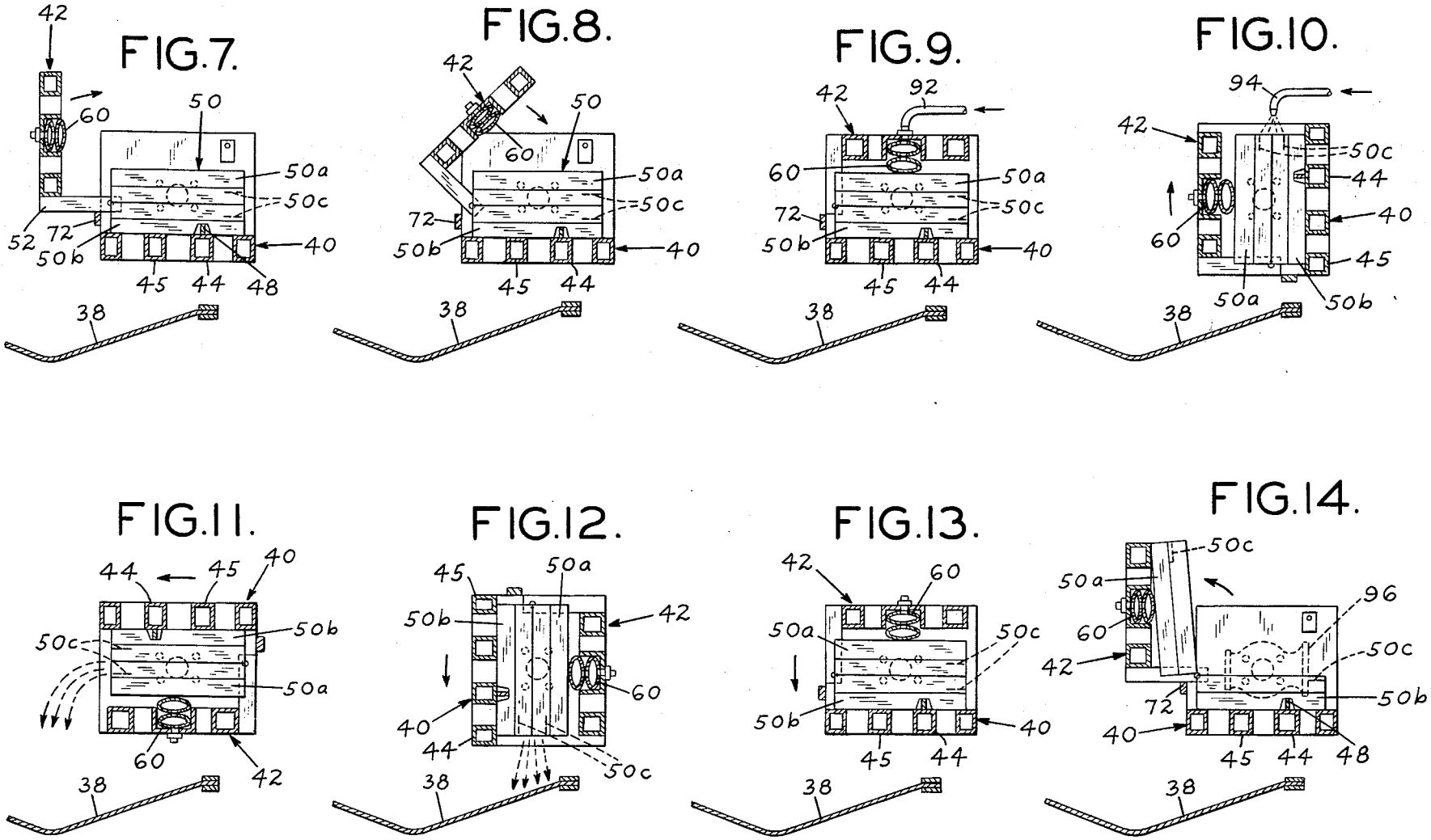
FIGS. 7 – 14 show various positions of the carriage during molding of hollowware articles.

The sequence of operation of the device and steps of the method are shown schematically in FIGS. 7 – 14. As shown in FIG. 7, the pivoted frame 42 is open and the molds 50 have been placed in position resting upon the upper surfaces of the frame members 44 and 45. The molds 50 comprise upper mold half 50*a* and lower mold half 50*b* and have filler openings 50*c*. A notch 90 in the lower mold half 50*b* is positioned in cooperating relationship with the retaining member 48. The notch 90 is shaped in such a manner as to be readily engaged with the retaining member 48 and yet to firmly position and retain the molds 50 against any movement to the left or right as viewed in FIG. 7. The molds 50 may be all of the same size or of varying sizes, but all will have their filler opening 50*c* positioned in the same direction. As shown, the filler opening is toward the right in FIG. 7. Other positions for the filler opening are possible as explained below. The operator then pivots the frame 42, as shown in FIG. 8, until it resides in the position shown in FIG. 9 at which point he latches the frame 42 in position by rotating the bell crank 69. He then inflates the inflatable cells 60*a* and 60*b* by applying an air hose of a conventional type 92 to the inflation valve. This expands both of the cells 60*a*, 60*b* against the upper surface of all of the molds 50 and presses against the molds 50 with sufficient firmness to hold them in place. The operator then rotates the mold assembly 90° to the upright position shown in FIG. 10 by operating the motor actuation switch 86. He then fills all the molds 50 with a conventional ceramic slip supplied through a hose 94 filling the molds 50 through openings 50*c*. The timer 88 is then actuated. The timer runs for any predetermined period of time which may be adjustable and which is determined by the desired thickness of the ceramic component of the slip that is to be built up in the inner surface of the mold. At the conclusion of the preset time, the timer actuates the motor 34 and the motor in turn rotates the carriage 10 to a first pouring position such as that shown in FIG. 11. While FIG. 11 shows the carriage 10 as having been moved approximately 90° to the left (counter-clockwise in the figures) from the position of FIG. 10, the actual position of the carriage in FIG. 11 depends upon the setting of the timer 88 which is set to rotate the carriage 10 for a predetermined number of seconds. It is only necessary that at this first pouring stage the outlet 50*c* be tipped far enough to permit at least the beginning of the pouring of the excess slip from the molds. As shown in FIG. 11, the position of the outlet 50*c* will permit approximately half or a bit more of the excess slip to be poured.

The carriage 10 remains in the position of FIG. 11 (or other chosen pouring position) for a dwell time determined by yet another adjustment on the timer mechanism 88.

Upon the completion of the dwell time in the position shown in FIG. 11 the timer will then operate the motor 34 again to rotate the carriage 10 to the second pouring stage or step as shown in FIG. 12 in which the mold opening 50*c* is positioned downwardly. When all of the excess slip has been poured from the molds in the position of FIG. 12 of the carriage 10, the operator then operates the motor control 86 to rotate the motor 34 in the opposite direction to return the carriage to the position shown in FIG. 13 which, it will be appreciated, is the same as the position of FIGS. 7 – 9 and represents a rotation of 270° from the position shown in FIG. 12. The operator then unlatches the pivoted frame 42 by rotation of the bell crank 69 and again tips the pivoted frame 42 upwardly into its open position. He then removes the "spare" from the pouring neck or opening 50*c* of the mold in conventional manner and lifts the upper half 50*a* of each mold upwardly, tilting them backwards to lean against the pivoted frame 42 as shown in FIG. 14. The formed ceramic ware 96 may then be removed from the lower supporting mold halves 50*b*.

It will be appreciated that instead of the two pouring stations as shown in FIGS. 11 and 12 the timing device 88 may be so construction as to provide for more than two pouring stages with a variable dwell time adjustable for each stage. Similarly, the timing device could be so constructed as to provide for very slow but continuous rotation of the carriage 10 from the position shown in FIG. 10 to that shown in FIG. 12. For such an operation, the speed reducing gear 33 is replaced with a variable speed device and the speed thereof made subject to the control of the timer 88. Further, the timer 88 may advantageously be interlocked with the manual motor operating device 86 to prevent manual operation of the motor 34 during that portion of the cycle in which the timer 88 controls rotation of the carriage 10 — i.e. from completion of the filling of the molds in FIG. 10 to completion of emptying of the molds in FIG. 12.

I claim:

1. Apparatus for use in casting ceramic holloware in molds comprising a substantially fixed support structure, an elongated carriage rotatably mounted in said support structure, said carriage comprising an elongated first frame and an elongated second frame, said second frame being pivotally mounted for movement with respect to said first frame to and from an open position in which said second frame is disposed at an angle to said first frame and a closed position in which said second frame is substantially parallel with said first frame, said frames in their closed position being adapted to hold therebetween a plurality of molds, said first frame having secured thereto a restraining member for engagement with said molds to substantially prevent relative movement of said molds with respect to said first frame during the casting of holloware and the rotation of said carriage, said restraining member comprising a metal bar extending substantially the length of said first frame, a portion of said bar extending inwardly from said first frame throughout substantially the length thereof and toward said second frame which portion engages notches in said molds, and a dual inflatable member on the inner side of said second frame which in the closed position thereof faces toward said first frame, said inflatable member including at least two cells pneumatically interconnected for substantially simultaneous inflation thereof whereby said carriage may hold molds of varying sizes simultaneously.

2. The apparatus of claim 1 in which said first and second frames generally define the bottom and the top respectively of said carriage when said carriage is in position to receive a plurality of said molds, said carriage also having a front and a rear side, and in which said molds may be positioned with their filler openings directed toward any one of said four sides.

3. The apparatus of claim 2 in which said molds are positioned with their filler openings disposed toward the front of said carriage.

4. The apparatus of claim 2 in which said molds are positioned with their filler openings directed toward said first frame.

5. The apparatus of claim 2 in which said molds are positioned with their filler openings directed toward said second frame.

6. The apparatus of claim 2 in which said molds are positioned with their filler openings disposed toward the rear of said carriage.

7. The apparatus of claim 1 in which said second frame includes an inflatable member which may be inflated to bear against molds resting upon said first frame, said inflatable member comprising at least two interconnected cells.

* * * * *